US009103109B2

(12) United States Patent
Armstrong et al.

(10) Patent No.: US 9,103,109 B2
(45) Date of Patent: Aug. 11, 2015

(54) MODULAR SUPPORT SYSTEMS

(71) Applicants: Peter Armstrong, Portland, OR (US); Wayne Armstrong, Portland, OR (US)

(72) Inventors: Peter Armstrong, Portland, OR (US); Wayne Armstrong, Portland, OR (US)

( * ) Notice: Subject to any disclaimer, the term of this patent is extended or adjusted under 35 U.S.C. 154(b) by 0 days.

(21) Appl. No.: 14/579,671

(22) Filed: Dec. 22, 2014

(65) Prior Publication Data

US 2015/0107180 A1 Apr. 23, 2015

Related U.S. Application Data

(63) Continuation of application No. PCT/US2013/060357, filed on Sep. 18, 2013.

(60) Provisional application No. 61/744,016, filed on Sep. 18, 2012, provisional application No. 61/957,900, filed on Jul. 15, 2013.

(51) Int. Cl.

| | |
|---|---|
| ***E04B 1/24*** | (2006.01) |
| ***E04B 5/29*** | (2006.01) |
| ***E04C 3/06*** | (2006.01) |

(Continued)

(52) U.S. Cl.

CPC ..... *E04B 1/2403* (2013.01); *E04B 1/24* (2013.01); *E04B 5/29* (2013.01); *E04C 3/06* (2013.01); *E04C 3/32* (2013.01); *E04B 2001/2415* (2013.01); *E04B 2001/2418* (2013.01); *E04B 2001/2448* (2013.01); *E04B 2001/2451* (2013.01); *E04B 2001/2463* (2013.01); *E04B 2001/2469* (2013.01); *E04B 2001/2472* (2013.01); *E04B 2001/2484* (2013.01);

(Continued)

(58) Field of Classification Search

CPC ..... E04B 1/2403; E04B 5/29; E04B 1/24; E04B 2001/2418; E04B 2103/06; E04B 2001/2469; E04B 2001/2451; E04B 2001/2415; E04B 2001/2448; E04C 3/06; E04C 3/32; E04C 2003/0452; E04C 3/294

USPC ..... 52/653.1, 655.1, 264

See application file for complete search history.

(56) References Cited

U.S. PATENT DOCUMENTS

| | | | | |
|---|---|---|---|---|
| 1,818,418 | A * | 8/1931 | Millard | 52/263 |
| 2,943,716 | A * | 7/1960 | Babcock | 52/653.1 |

(Continued)

FOREIGN PATENT DOCUMENTS

| | | | |
|---|---|---|---|
| EP | 1715108 | A1 * | 10/2006 |
| FR | 2745313 | A1 * | 8/1997 |
| GB | 1549627 | A * | 8/1979 |
| WO | WO 9836134 | A1 * | 8/1998 |
| WO | WO 9955974 | A1 * | 11/1999 |

*Primary Examiner* — Adriana Figueroa

(74) *Attorney, Agent, or Firm* — Mohr Intellectual Property Law Solutions, PC

(57) ABSTRACT

Modular support systems for supporting multi story buildings including plates having bottom major faces and top major faces, the plates defining bolt holes extending through the plates, vertical columns extending from bottom ends to top ends opposite the bottom ends, the bottom ends of the vertical columns being welded to the top major faces of the plates, and horizontal columns having bottom sides and top sides opposite the bottom sides, the bottom sides of the horizontal columns being welded to the top end of the vertical columns. In some examples, the horizontal column defines bolt holes being positioned to align with the bolt holes defined in the plate. Some examples include pluralities of structural units selectively fastened together in a vertical arrangement, with each structural unit configured to selectively couple with vertically adjacent structural unit. Some examples define buildings including disclosed support systems.

20 Claims, 7 Drawing Sheets

(51) Int. Cl.

| | |
|---|---|
| ***E04C 3/32*** | (2006.01) |
| *E04H 1/04* | (2006.01) |
| *E04C 3/294* | (2006.01) |
| *E04C 3/04* | (2006.01) |

(52) U.S. Cl.
CPC ..... *E04B2103/06* (2013.01); *E04C 3/294* (2013.01); *E04C 2003/0452* (2013.01); *E04H 1/04* (2013.01)

(56) References Cited

U.S. PATENT DOCUMENTS

| | | | | |
|---|---|---|---|---|
| 7,076,926 | B2 * | 7/2006 | Kasai et al. | 52/167.8 |
| 7,299,596 | B2 * | 11/2007 | Hildreth | 52/695 |
| 7,637,069 | B2 * | 12/2009 | Iri et al. | 52/655.1 |
| 2010/0037546 | A1 | 2/2010 | Beck et al. | |

* cited by examiner

MODULAR SUPPORT SYSTEMS

CROSS REFERENCE TO RELATED APPLICATIONS

This application claims priority to the following applications, each of which are incorporated by reference for all purposes:

U.S. Provisional Application, Ser. No. 61/744,016, filed on Sep. 18, 2012;

U.S. Provisional Application, Ser. No. 61/957,900, filed on Jul. 15, 2013; and

Patent Cooperation Treaty Application, No. PCTUS2013060357, having an international filing date of Sep. 18, 2013.

TECHNICAL FIELD

The present disclosure relates generally to modular support systems, including those configured to provide load-bearing support to multi-story buildings.

BACKGROUND

The present disclosure relates generally to modular support systems for multi-story buildings. In particular, modular support systems that include a plurality of load-bearing structural units are described.

Known building support systems are not entirely satisfactory for the range of applications in which they are employed. Many buildings, for example, implement a concrete column-based support structure. Constructing buildings with concrete column-based support structures is inefficient. For example, constructing a building with a concrete column-based support system may require builders to iteratively pour the concrete structural elements of each floor individually.

In such a process, all of the structural work on a floor must be completed before any structural work can begin on a vertically adjacent floor. This iterative process often bottlenecks construction projects and delays progress.

Further, concrete column-based construction requires a large amount of work to be performed by on-site laborers. The large amount of on-site labor further increases costs and creates scheduling difficulties.

Constructing buildings with structural steel-based support systems are another conventional construction method, but structural steel-based methods do not adequately address many of the shortcomings of concrete-based methods. For example, structural steel drastically reduces the amount of concrete to be poured during construction. This decrease in labor, however, is offset by the need to individually weld a large number of structural steel elements. Indeed, structural steel supports often require builders to iteratively and labor-intensively construct each floor on site. Accordingly, conventional structural steel systems are often as labor intensive, expensive, and slow as conventional concrete-based projects.

Further, many buildings constructed with conventional structural steel-based support systems include irregular floor plans that require a variety of structural members to be used over the course of construction. At some times during production, stocks may be depleted due to one or more of delayed deliveries, depleted stocks, errors in ordering, or other causes of depleted supplies. Such shortfalls in supply may result in delays and additional labor costs.

Wood-based support systems address some of the shortcomings of conventional structural steel and concrete based support systems. For example, labor costs associated with some wood supported projects are dramatically reduced compared to structural steel and concrete supported projects. Further, wood-based support systems may, in some examples, be quicker and less labor-intensive to construct.

Many wood-based support systems, however are unable to adequately support multi-story buildings, particularly those that include more than two floors. Accordingly, wood-based support systems are only adequate for very small-scale construction projects and are inadequate for larger-scale projects including 3 or more floors. As a result, wood-based support systems are inadequate for larger-scale, multi-story applications. As a result, there exists a need for support systems that take advantage of the lower cost provided by wood-based support systems while supporting the multi-story structures that currently require steel or concrete-based support systems.

Thus, there exists a need for support systems that improve upon and advance the design of known support systems. In particular, there exists a need for support systems that are adequate to support larger-scale multi-floor projects that require less on-site labor than conventional concrete and/or structural steel-based projects. Examples of new and useful modular support systems relevant to these and other needs existing in the field are discussed below.

SUMMARY

The present disclosure is directed to modular support systems for supporting multi-story buildings including plates having bottom major faces and top major faces, the plates defining bolt holes extending through the plates, vertical columns extending from bottom ends to top ends opposite the bottom ends, the bottom ends of the vertical columns being welded to the top major faces of the plates, and horizontal columns having bottom sides and top sides opposite the bottom sides, the bottom sides of the horizontal columns being welded to the top end of the vertical columns. In some examples, the horizontal column defines bolt holes being positioned to align with the bolt holes defined in the plate. Some examples include pluralities of structural units selectively fastened together in a vertical arrangement, with each structural unit configured to selectively couple with a vertically adjacent structural unit. Some examples define buildings including the disclosed support systems.

DETAILED DESCRIPTION

The disclosed modular support systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various modular support systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
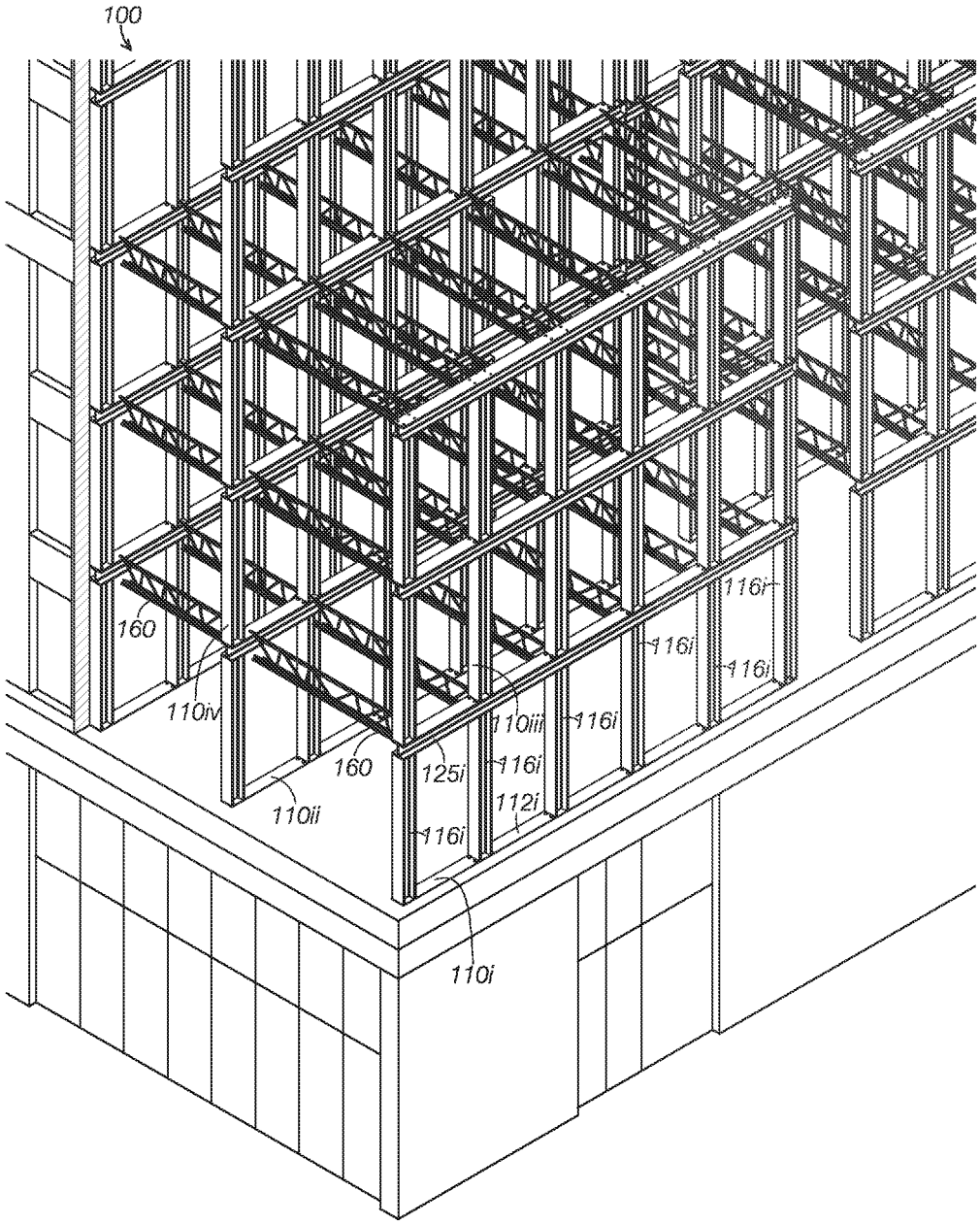
FIG. 1 is a perspective view of a building including a first example of a modular support system.

With reference to FIGS. 1-8, a first example of a modular support system, system 100, will now be described. As FIG. 1 illustrates, system 100 includes a plurality of structural units arranged to define a building support structure. For example, system 100 includes, among other structural units, a first structural unit 110*i*, a second structural unit 110*ii*, a third structural unit 110*iii*, and a fourth structural unit 110*iv*.

System 100 provides a structural steel-based support system configured to support a multi-story building. System 100 is configured to support at least a minimum load-bearing capacity of the building, the minimum load-bearing capacity being selected to support the structural elements and the expected contents of the building. Further, system 100 provides a modular structure constructed of parts that may be largely fabricated off-site at a production facility before being installed at a construction site.

Additionally, system 100 includes a substantially identical set of pre-fabricated structural units, thereby drastically reducing the number of unique parts that are required to be stocked and installed on-site during construction. System 100 further supports a method of installing the pre-fabricated structural units without welding at the construction site, which may reduce or eliminate the need for on-site welders.

As a result, system 100 provides a structural steel-based support system with efficiency gains through pre-fabrication and a simpler, weld-free install process. Further, by shifting a significant amount of the labor to off-site pre-fabrication, system 100 dramatically reduces on-site build times. Through these efficiency gains, system 100 allows construction of multi-story buildings at prices and build times that are dramatically lower than would be associated with conventional structural steel-based construction methods. Indeed, the disclosed systems allow multi-story structural steel-based projects to be constructed at times and costs typically associated with projects with wood-based structural supports.

As FIG. 1 illustrates, each of the structural units of system 100 includes substantially the same basic components. First structural unit 110*i*, for example, includes a plate 112*i*, a plurality of vertical columns 116*i*, and a horizontal column 125*i*. While some structural units may define different lengths, heights, and/or a different number of vertical columns, each structural unit is constructed of these basic components.

This disclosure notes, however, that all structural units that are horizontally aligned and vertically coupled with one another (e.g., those that are positioned on the same portion of the floor plan in each floor) are substantially identical. As a result, each floor utilizes substantially identical components for installation as every other floor in the building. This uniformity in construction assists supply management and parallel construction, as structural units and other parts available on-site may often be used at multiple parts of system 100.

As FIG. 1 shows, second structural unit 110*ii* is horizontally spaced from first structural unit 110*i* by a predetermined room width distance. This allows first structural unit 110*i* and second structural unit 110*ii* to support, between them, a housing unit with a width of the predetermined room width. Aside from the different position, second structural unit 110*ii* is otherwise substantially identical to first structural unit 110*i*, and includes the same core components. Further, because they are on the same floor, first structural unit 110*i* and second structural unit 110*ii* both define a height of a predetermined floor height.

Likewise, third structural unit 110*iii*, which is vertically-coupled to first structural unit 110*i*, is substantially identical to first structural unit 110*i*. Similarly, fourth structural unit 110*iv* is vertically coupled to second structural unit 110*ii*, and is also substantially identical to second structural unit 110*ii*. As FIG. 1 illustrates, third structural unit 110*iii* and fourth structural unit 110*iv* are each substantially identical to both first structural unit 110*i* and second structural unit 110*ii*.

Although third structural unit 110*iii* and fourth structural unit 110*iv* are the same height as the other illustrated structural units, this disclosure contemplates that structural units on different floors may define different heights as long as the height of structural units on the same floor all define a consistent height.

Figure 2:
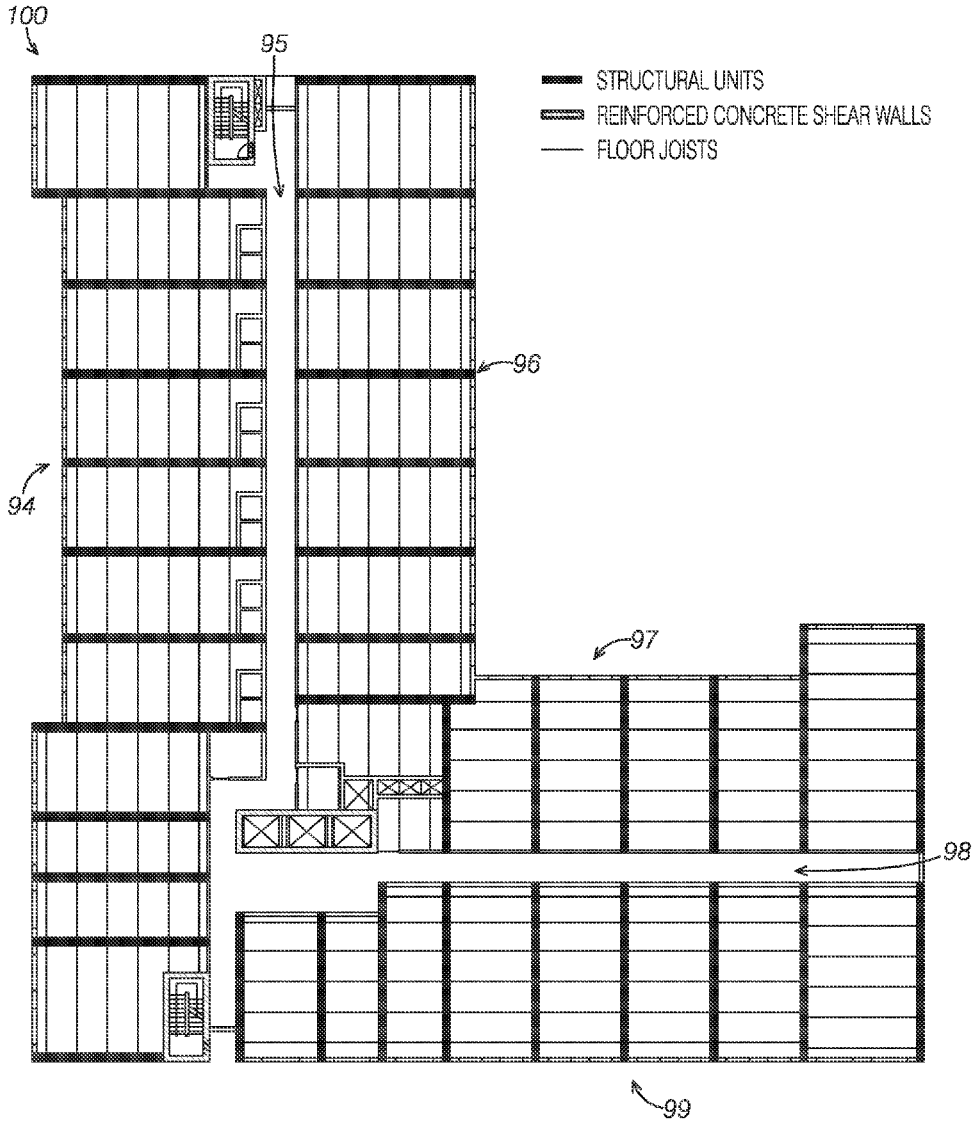
FIG. 2 is a top view of the building shown in FIG. 1 depicting a floor plan defined by the modular support system.

FIG. 2 illustrates an example floor plan that may be constructed using system 100. As FIG. 1 shows, system 100 favors a construction wherein vertically coupled structural units are uniformly stacked upon one another through the entire height of an associated building. Because of this modular design, the placement of the structural units shown in the floor plan in FIG. 2 will be repeated on every floor in the building shown in FIG. 2. As will be discussed in more detail below, designers may be afforded a good amount of freedom in adjusting the housing unit layout of each floor by routing passageways through the structural units, particularly between vertical columns, and by strategically placing non-load bearing walls throughout the floor.

As FIG. 2 shows, each structural unit extends at a predetermined structural unit length, meaning, by extension, that the plate and horizontal unit extend at equal lengths equal to the predetermined structural unit length associated with the structural unit. Vertically stacked structural units, in many examples, each have a uniform predetermined structural unit length. In some examples, the predetermined structural unit length may be uniform amongst all structural units in a building. In other examples, the predetermined structural unit length may be uniform against all or a majority of all structural units in a section. Other examples may include structural units widely disparate structural unit lengths amongst structural units on the same floor, such as the example shown in FIG. 2.

As FIG. 2 illustrates, the structural units of system 100 are separated into a plurality of distinct sections, including a first section 94, a second section 96, a third section 97, and a fourth section 99. As FIG. 2 shows, each section includes a group of parallel, aligned structural units.

As FIG. 2 shows, structural unit sections may be oriented in a variety of different directions in the same building. For example, the structural units in first section 94 and second section 96 are parallel to one another, whereas third section 97 and fourth section 99 are perpendicular to first section 94 and second section 96, but parallel to one another. Including multiple distinct structural unit sections oriented a variety of ways provides great flexibility in building shape and design while maintaining the module structure of system 100.

As FIG. 2 shows, first section 94 and second section 96 are spaced from one another to define a corridor 95 between them. Similarly, third section 97 and fourth section 99 are similarly spaced to define a corridor 98, which is similarly sized and connected to corridor 95. Corridor 95 and corridor 98 may allow people to move through the building to navigate between the housing units defined by the structural units.

While corridor 95 and corridor 98 are routed through spaces between structural unit sections, this is not specifically required. In fact some examples may lack distinct structural unit sections altogether. Indeed, structural units may, in some examples, be installed over the entire area of a building's floor plan and thereby essentially define only a single section of structural units. In such an example, the entire floor plan of the associated building may be defined by a single row of parallel structural units.

In examples lacking space between structural unit sections, corridors may be routed between the vertical columns of a floor's structural units. Indeed, by strategically placing non-load bearing walls, carefully routing corridors between vertical columns, and selectively placing walls and/or passageways between vertical columns of structural units, buildings with single structural unit sections may afford even greater flexibility in floor plan design than those with multiple sections.

Figure 3:
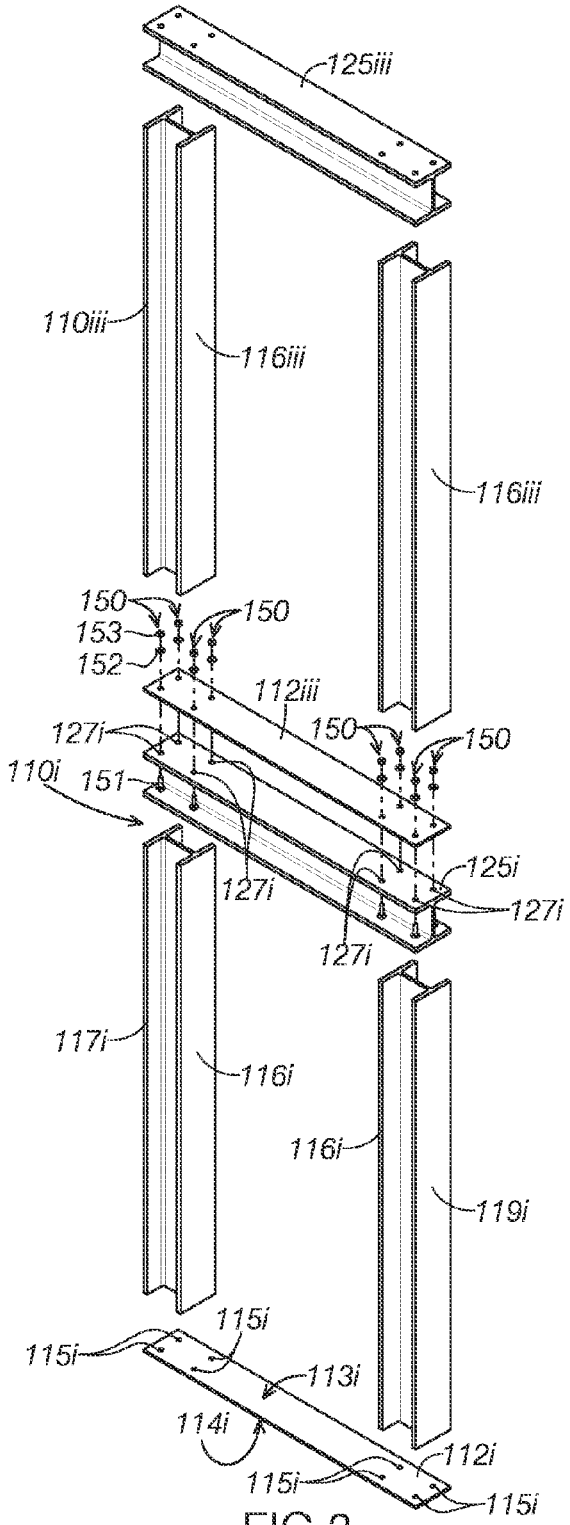
FIG. 3 is an exploded view of a portion of two vertically adjacent structural units included in the modular support system shown in FIG. 1.

FIG. 3 illustrates a portion of both first structural unit 110*i* and third structural unit 110*iii* exploded to show the individual components of each structural unit. As FIG. 3 shows, first structural unit 110*i* includes plate 112*i*, vertical columns 116*i*, and horizontal column 125*i*. FIG. 3 illustrates two illustrative vertical columns 116*i*: a first vertical column 117*i* and a second vertical column 119*i*.

Figure 4:
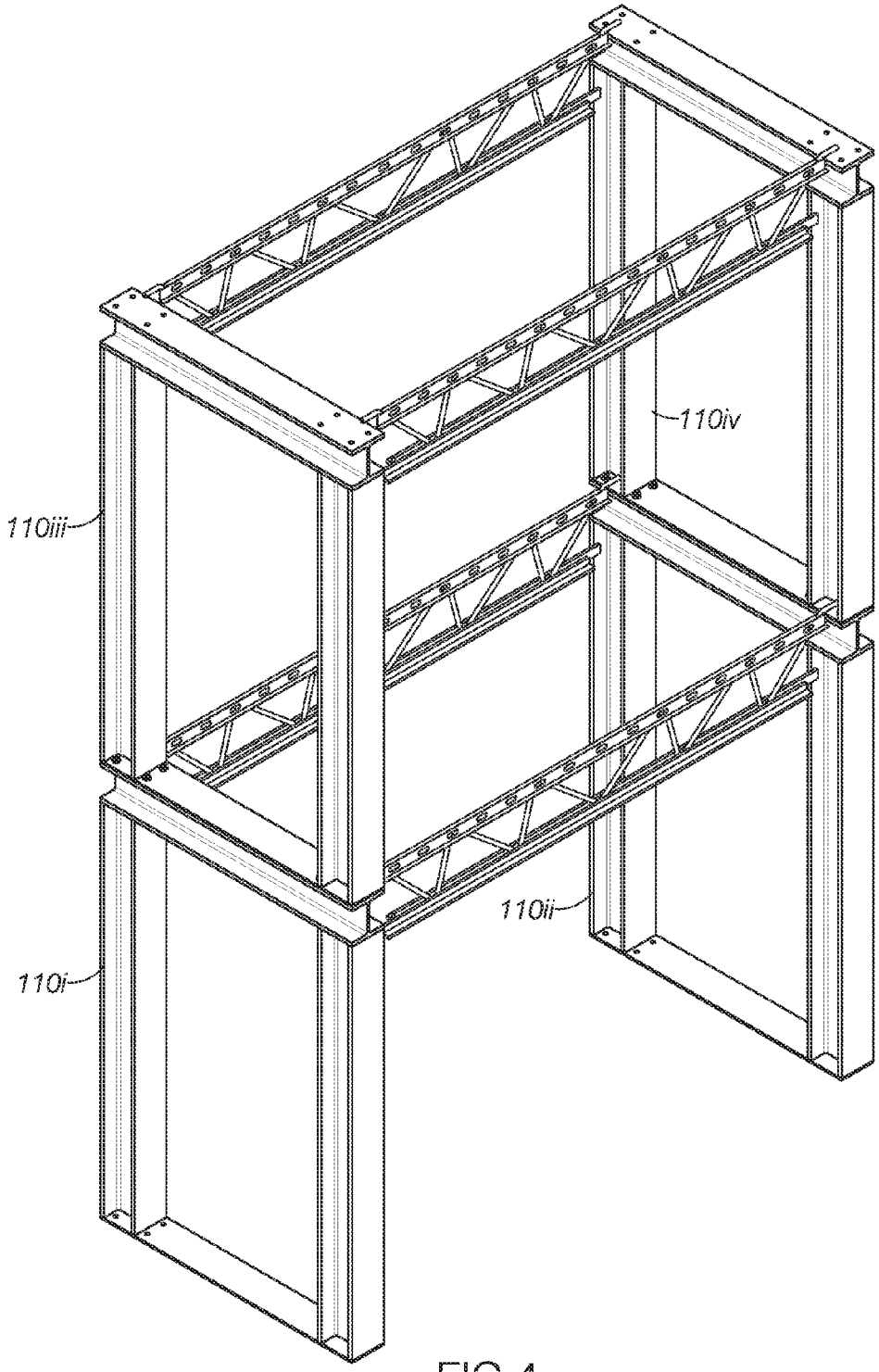
FIG. 4 is a perspective view of a portion of four coupled structural units included in the modular support system shown in FIG. 1.

First structural unit 110*i*, as displayed in FIGS. 3 and 4, represents the most basic building block of system 100. As FIG. 1 shows, structural units will, in most cases, include at least two vertical columns extending between the structural unit's plate and horizontal bar, though they may include significantly more than two. Vertical columns are often spaced along the length of structural units by a predetermined column spacing distance. The predetermined column spacing distance is often calculated based on the expected necessary load capacity of the modular support system and the minimum distance required to allow passage between the vertical columns.

The number of columns on a particular structural unit is typically the maximum amount of columns that will fit along the length of the structural unit when spaced the predetermined column spacing distance. Some structural units, may additionally include an additional column at one or both end that is spaced from the adjacent column by less than the predetermined column spacing distance.

As FIG. 1 shows, plate 112*i* extends horizontally along the length of first structural unit 110*i*. Plate 112*i* is welded to the bottom of each vertical column 116*i*. To avoid redundancy, this disclosure focuses on plate 112*i* specifically to describe the disclosed plates generally. As FIG. 1 shows, each structural unit includes a plate substantially similar to plate 112*i*. Unless this disclosure discusses specific differences between plate 112*i* and other plates, the reader should reference the discussion of plate 112*i* for details of the other plates.

As FIG. 3 shows, plate 112*i* defines a top major face 113*i*, a bottom major face 114*i*, and a plurality of plate bolt holes 115*i*. As FIG. 4 shows, top major face 113*i*, when plate 112*i* is connected to vertical columns 116*i*, extends horizontally along the bottom end of each paired vertical column.

Plate 112*i* does not necessarily bear any load, but rather acts as an interface allowing first structural unit 110*i* to be coupled with a vertically adjacent structural unit below first structural unit 110*i*. Specifically, as FIG. 3 shows, plate bolt holes 115*i* may be positioned to be aligned with bolt holes in the horizontal column of a paired structural unit. By aligning the bolt holes in this manner, plate 112*i* may allow the vertically adjacent structural units to be coupled with one another by using a fastener, rather than welding. This may reduce on-site welding costs while simplifying the installation process.

As FIG. 1 illustrates, vertical columns 116*i* are welded to plate 112*i*. FIG. 3 shows an example portion of first structural unit 110*i*, specifically illustrating first vertical column 117*i* and second vertical column 119*i* in greater detail. As FIG. 1 shows, vertical columns 116*i* include a plurality of vertical columns that are positioned to be substantially equally spaced from one another across the entire length of first structural unit 110*i*.

As FIG. 2 shows, various structural units used in a particular design may extend at different lengths from one another. The number of vertical columns included in such structural units may be adjusted proportionately to such differences in length.

Each vertical column on a particular floor is often identical, which may increase the uniformity of the materials of system 100. Further, the vertical columns of each structural unit are often welded to the associated plate during an off-site prefabrication process. This may reduce on-site work and result in a cheaper, more efficient build process.

To avoid redundancy, this disclosure focuses on first vertical column 117*i* specifically to describe disclosed vertical columns generally. As FIG. 1 shows, each structural unit includes vertical columns substantially similar to first vertical column 117*i*. Unless this disclosure discusses specific differences between first vertical column 117*i* and other vertical columns, the reader should reference the discussion of first vertical column 117*i* for details of the other vertical columns.

As FIG. 3 shows, first vertical column 117*i* extends at a length selected to size first structural unit 110*i* at a predetermined floor height, in some examples, first vertical column 117*i* may be the same height as vertical columns on all of the other floors of system 100. In other examples, however, vertical columns on other floors may define heights different from first vertical column 117*i*.

Although all vertical columns 116*i* extend substantially straight vertically and perpendicularly to plate 112*i*, this is not specifically required. Some examples may include one or more vertical columns that extend from plate 112*i* toward horizontal column 125*i* at an angle other than 90 degrees. Additionally or alternatively, one or more supplemental vertical supports may extend between plate 112*i* and horizontal column 125*i* at an angle other than 90 degrees.

As FIG. 3 illustrates, first vertical column 117*i* defines a wide structural steel beam defining a first side flange, a second side flange spaced from the first side flange, and a web extending between the side flanges. First vertical column 117*i* defines a gauge selected to provide a portion of the load-bearing support to a building supported by system 100. First vertical column 117*i* is commonly referred to as a w-beam or i-beam. This particular beam shape and construction material is not specifically required, however.

Structural units on the upper floors of a building are required support a lessened portion of the building's expected minimum load-bearing capacity than those on lower floors. Accordingly, the layout of upper floors may have adjusted layouts that remove one or more structural units to accommodate larger rooms or housing units.

In some examples, vertical columns on different floors or at different horizontal positions may define different gauges. For example, columns on lower floors may define larger gauges to accommodate the larger share of load-bearing support that lower floors must provide.

As FIG. 1 illustrates, horizontal column 125*i* extends horizontally substantially parallel to plate 112*i* and is welded to the top of vertical columns 116*i*. To avoid redundancy, this disclosure focuses on horizontal column 125*i* specifically to discuss the features of disclosed horizontal columns generally. As FIG. 1 shows, each structural unit includes a horizontal column substantially similar to horizontal column 125*i*. Unless this disclosure discusses specific differences between horizontal column 125*i* and other horizontal columns, the reader should reference the discussion of horizontal column 125*i* for details of the other horizontal columns.

As FIG. 1 shows, horizontal column 125*i* is substantially equal in length to plate 112*i*. FIG. 3 discloses a portion of horizontal column 125*i* in greater detail. As FIG. 3 shows, horizontal column 125*i* defines a structural steel wide-flange beam with a top flange defining a top side, a bottom flange defining a bottom side, and a web extending between the top flange and the bottom flange.

As FIG. 1 shows, horizontal column 125*i* is welded to each vertical column 116*i*. In some examples, horizontal column 125*i* is welded to vertical columns 116*i* in an off-site prefabrication process. By performing these welds off-site, the on-site construction workload may be reduced and a more efficient build process may result. Indeed, because horizontal column 125*i*, vertical columns 116*i*, and plate 112*i* are all able to be welded to one another off-site, first structural unit 110*i*, along with all of the other structural units, is specifically configure to be prefabricated off-site and delivered to a construction site. Once on site, the structural units may be installed and coupled with one another without additional on-site welding, resulting in a low-cost, simple install process.

As FIG. 3 illustrates, horizontal column 125*i* defines a plurality of horizontal beam bolt holes 127*i* extending through the top flange. As FIG. 3 shows, horizontal beam bolt holes 127*i* are horizontally aligned with plate bolt holes 115*i*.

Because the horizontal bolt holes and plate bolt holes of structural units are aligned with one another, structural units are configured to be stacked on one another. In particular, the structural units are configured to be stacked with the horizontal beam and plate bolt holes aligned with one another as plates are engaged with horizontal beams of adjacent structural units. More precisely, the plate holes of an upper structural unit may be aligned with and proximate to the horizontal beam holes of a lower structural unit when the upper structural unit is stacked on the lower structural unit.

Figure 5:
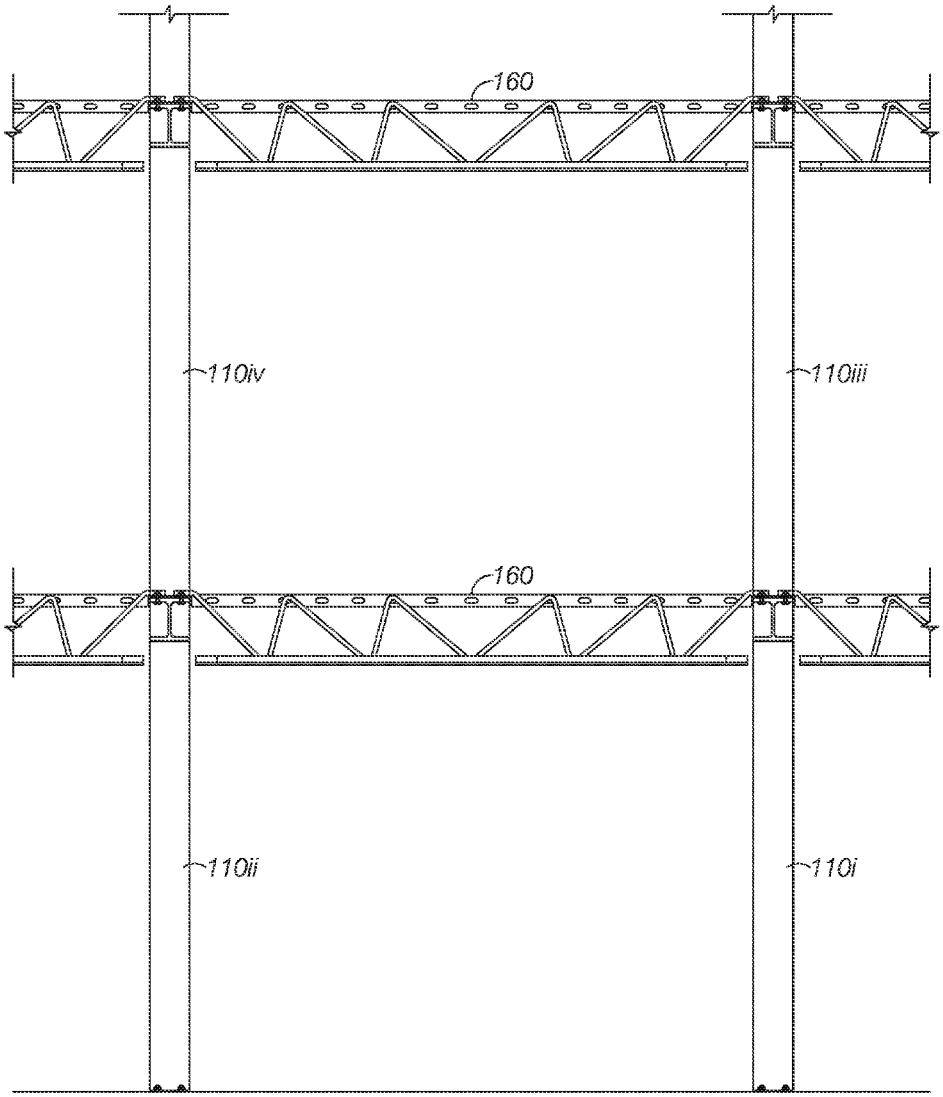
FIG. 5 is a side elevation view of coupled structural units included in the modular support system shown in FIG. 1 depicting the structural units supporting floor joists.
Figure 6:
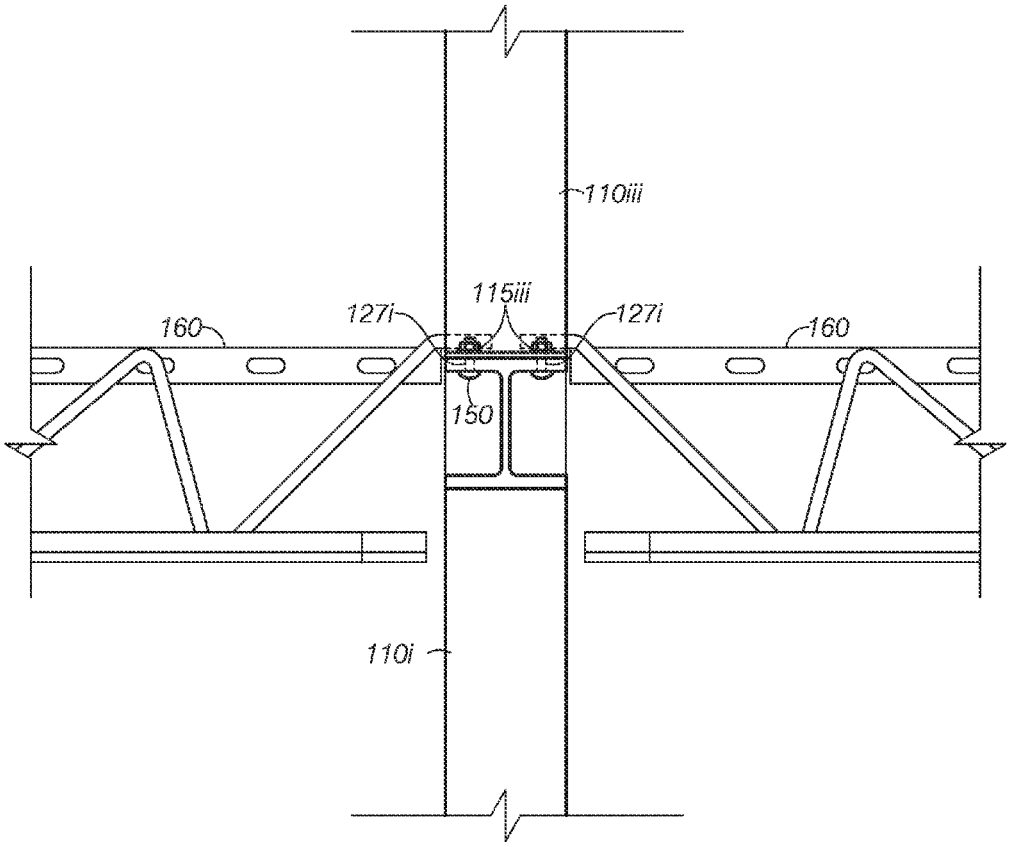
FIG. 6 is a close up side elevation view of coupled vertically adjacent support units.

FIGS. 3 and 4 illustrate a portion of second structural unit 110*ii* in addition to first structural unit 110*i*. As FIGS. 3-5 show, second structural unit 110*ii* is configured to couple to first structural unit 110*i* using a fastener. FIG. 6 illustrates a close up view showing additional details of an example attachment point between first structural unit 110*i* and second structural unit 110*ii*. As FIG. 3 shows, second structural unit 110*ii* includes a plurality of plate bolt holes 115*ii* that are positioned to align with horizontal beam bolt holes 127*i*.

As FIG. 3 illustrates, system 100 includes a plurality of fasteners 150 configured to be routed through the aligned plate bolt holes 115*ii* and horizontal beam bolt holes 127*i*. As FIG. 6 shows, fasteners 150 may be routed through plate bolt holes 115*ii* and horizontal beam bolt holes 127*i*. When so routed, fasteners 150 extend through the aligned bolt holes to selectively couple first structural unit 110*i* to second structural unit 110*ii*.

As FIG. 3 shows, fasteners 150 each specifically define a bolt 151, a washer 152, and a nut 153. As FIG. 4 shows, second structural unit 110*ii* may be coupled to first structural unit 110*i* by routing bolt 151 through plate bolt holes 115*ii* and horizontal beam bolt holes 127*i* with a wide portion side of bolt 151 proximate first structural unit 110*i* and a threaded portion on a side of bolt 151 proximate second structural unit 110*ii*, slidingly receiving washer 152 on the threaded portion, and screwingly receiving nut 153 on the threaded portion.

As shown in FIG. 4, coupling second structural unit 110*ii* to first structural unit 110*i* using fasteners 150 allows second structural unit 110*ii* to be non-weldingly coupled to first structural unit 110*i*.

Because of the bolt-based structural unit coupling methodology described above, the pre-fabricated structural units may be coupled to one another on-site without any welding. As a result, system 100 may be constructed at a construction site without performing any on-site welding. In fact, the bolt-based installation method may be relatively easy to attach without any substantial, heavy equipment.

Reducing the need for on-site welding to couple structural units from one another provides a myriad of benefits. For example, on-site welding is one of the most significant costs of constructing many conventional steel-based support systems; by reducing the amount of welding required, system 100 may drastically lower total construction costs. Additionally or alternatively, the bolt-based coupling methodology may be quicker and easier to perform than on-site welds.

When structurally units are installed and coupled, each structural unit may optionally support removable, non-load bearing walls that extend along structural units between adjacent vertical columns. This may afford designers and constructors great flexibility in laying out floor plans for housing units. In some portions of a constructed building, walls may extend along the entire length of a pair of horizontally adjacent structural units. In such portions, housing units may consist of only the space between horizontally adjacent structural units.

In other portions, however, one or more structural units may define doors or voids between some vertical columns. By defining a void or doorway between vertical columns, designers may be able to allow passage through the structural unit. This may allow for housing units that span across multiple structural units.

Further, non-structural walls or doorways may extend across a pair of horizontally adjacent structural units. Such non-structural walls may be useful, for example, to provide entrances for the housing units defined by horizontally adjacent structural units.

As FIGS. 1 and 4 show, system 100 is configured to support floor joists 160 across pairs of horizontally adjacent structural units spaced by a predetermined room width. In some examples, floor joists used with disclosed systems may define Hambro® brand floor joists. As FIG. 2 shows, a plurality of floor joists 160 extend across each pair of horizontally adjacent structural units at regular intervals along the entire length of the adjacent structural units.

FIG. 4 shows two pairs of horizontally adjacent structural units spaced by a predetermined room width, including first structural unit 110*i* spaced from second structural unit 110*ii* and second structural unit 110*ii* spaced from fourth structural unit 110*iv*. As FIG. 4 shows, floor joists 160 are configured to rest on the horizontal columns of the paired structural members.

As FIG. 5 illustrates, floor joists 160 are configured to extend straight across first structural unit 110*i* and second structural unit 110*ii* and third structural unit 110*iii* and fourth structural unit 110*iv*. FIG. 6 shows a close up view showing additional details of floor joists 160 resting on and being supported by third structural unit 110*iii*. As FIG. 6 shows, floor joists 160 define posts 162 that are configured to rest on the horizontal columns of structural units.

Figure 7:
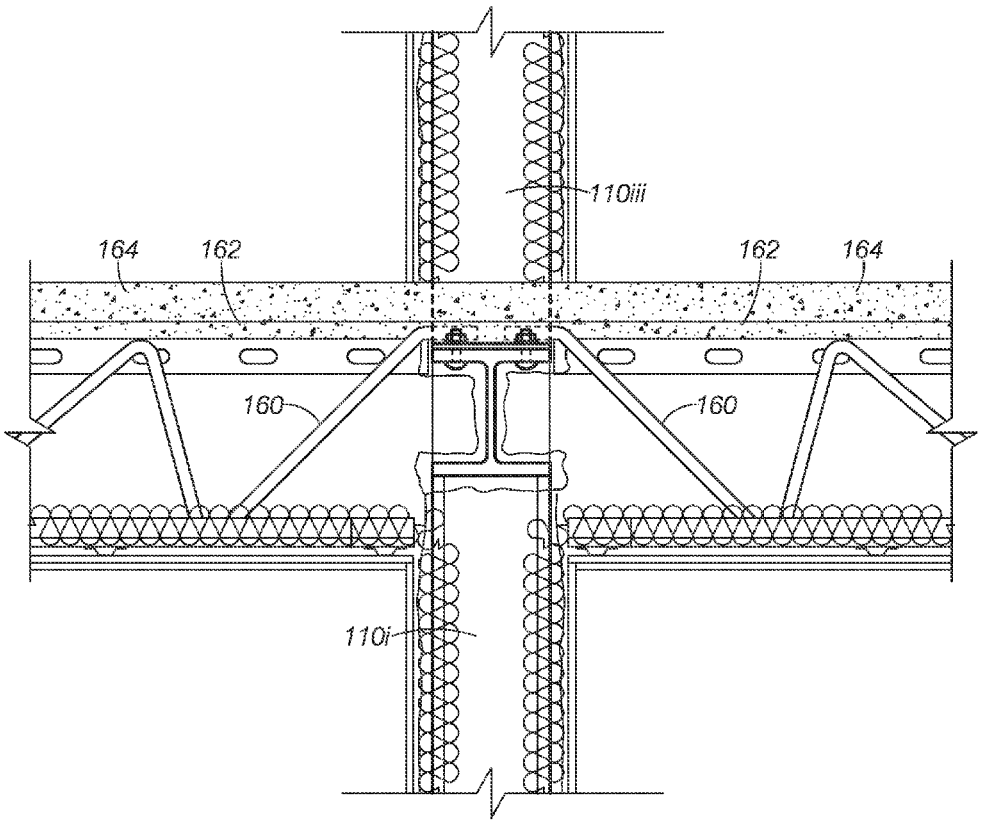
FIG. 7 is a close up side elevation view of coupled vertically adjacent support units supporting poured concrete flooring.

As FIG. 7 shows, floor joists 160 are configured to support a planar steel deck 162 to rest on floor joists 160 between horizontally adjacent structural units. In some examples the steel decks may extend over the entire area between horizontally adjacent structural units. The steel decks may be used to vertically support poured concrete at a floor level defined by the horizontally adjacent structural units flooring until the concrete dries. In the example shown in FIG. 7, system 100 supports floor joists 160 capable of supporting 1.5 inch steel decks 162 and 3.5 inch concrete slabs 164.

Though system 100 is configured to bear the entire minimum load necessary to support the building, pouring concrete floors may provide additional lateral stability to structural units.

As FIG. 2 shows, buildings constructed with system 100 may include concrete shear walls 89 around, for example, stairwells. This is not required, however. Further, concrete shear walls 89 are not necessary to satisfy the minimum load capacity of associated buildings.

As a result, system 100, when constructed, is configured to support independent of any additional load bearing supports, such as concrete columns. Indeed, this disclosure specifically contemplates that the disclosed modular, load-bearing support structures are capable of supporting at least the minimum load-bearing capacity selected to support structural elements of a multi-story building and the expected contents of the building.

The inventions described above may be alternatively described according to the following non-limiting embodiments.

In a first embodiment of a modular support system for supporting, a multi-story building, the modular support system may include a plate having a bottom major face and a top major face opposite the bottom major face, a vertical column extending from a bottom end to a top end opposite the bottom end, the bottom end of the vertical column being welded to the top major face of the plate, and a horizontal column having a bottom side and a top side opposite the bottom side, the bottom side of the horizontal column being welded to the top end of the vertical column.

In some examples of the first embodiment, the plate defines bolt holes extending from the top major face through the plate to the bottom major face.

In some examples of the first embodiment, the horizontal column defines bolt holes extending through the top side of the horizontal column being positioned to align with the bolt holes defined in the plate.

In some examples of the first embodiment, the plate, the vertical column, and the horizontal column collectively define a first structural unit. Some examples of the first embodiment further comprise a second structural unit coupled to the first structural unit with bolts. In some examples with a second structural unit, the second structural unit comprises a second plate having a bottom major face and a top major face opposite the bottom major face and the second plate defines bolt holes extending from the top major face of the second plate through the second plate to the bottom major face of the second plate. In some examples including a second plate, the bolt holes defined in the second plate align with the bolt holes defined in the top side of the horizontal column of the first structural unit. In some examples with a second structural unit, the second structural unit comprises a second vertical column extending from a bottom end to a top end opposite the bottom end and the bottom end of the second vertical column is welded to the top major face of the second plate. In some examples having a second structural unit, the second structural unit comprises a second horizontal column having a bottom side and a top side opposite the bottom side, the bottom side of the second horizontal column being welded to the top end of the second vertical column.

Some examples including a second structural unit further comprise bolts extending through the bolt holes defined in the second plate and through the bolt holes defined in the top side of the horizontal column of the first structural unit to selectively couple the first structural unit with the second structural unit.

In some examples including a second structural unit with second vertical columns, vertical column of the first structural unit defines a first load-bearing metallic beam, the second vertical column defines a second load-bearing metallic column, and the vertical column of the first structural unit defines a first column gauge that is greater than a second column gauge defined by the second vertical column.

In some examples of the first embodiment, the horizontal column defines a wide-flange beam including a top flange defining the top side, a bottom flange spaced from the top flange, the bottom flange defining the bottom side, and a web extending between the top flange and the bottom flange. In some examples wherein the horizontal column defines a wide-flange beam, the bolt holes extend through the top flange.

In some examples of the first embodiment, the vertical column defines a wide-flange beam including a first side flange, a second side flange spaced from the first side flange, and a web extending between the first side flange and the second side flange.

In some examples of the first embodiment, the horizontal column extends horizontally to a predetermined structural unit length, and the plate extends horizontally to the predetermined structural unit length.

In some examples wherein the horizontal column and plate extend to a predetermined structural unit length, the plate, the vertical column, and the horizontal column collectively define a first structural unit and the structural unit includes a plurality of supplemental vertical columns extending between the plate and the horizontal column, the supplemental vertical columns positioned to be equally spaced along the length of the structural unit.

Some examples defining a plurality of vertical columns, further comprise a second structural unit horizontally spaced from the first structural unit by a predetermined wall spacing distance and vertically aligned with the first structural unit. In some examples with a second structural unit, the second structural unit includes a second plate having a bottom major face and a top major face opposite the bottom major face, the second plate defines bolt holes extending from the top major face of the second plate through the second plate to the bottom major face of the second plate. In some examples including a second structural unit, the second structural unit includes a second vertical column extending from a bottom end to a top end opposite the bottom end, the bottom end of the second vertical column being welded to the top major face of the second plate. In some examples including a second structural unit, the second structural unit includes a second horizontal column having a bottom side and a top side opposite the bottom side, the bottom side of the second horizontal column being welded to the top end of the second vertical column. In some examines with a second structural unit, the second horizontal column defines bolt holes extending through the top side of the second horizontal column being positioned to align with the bolt holes defined in the second plate.

In some examples including a second structural unit, the second structural unit is horizontally aligned with the first structural unit.

In some examples including a second structural unit, the second plate extends horizontally to the predetermined structural unit length and the second horizontal column extends horizontally to the predetermined structural unit length.

Some examples including a second structural unit further comprise a third structural unit, the third structural unit being coupled to the first structural unit with bolts. In some examples including a third structural unit, the third structural unit includes a third plate having a bottom major face and a top major face opposite the bottom major face, the third plate defining bolt holes extending from the top major face of the third plate through the third plate to the bottom major face of the third plate. In some examples including a third plate, the bolt holes defined in the third plate align with the bolt holes defined in the top side of the horizontal column of the first structural unit. In some examples including a third structural unit, the third structural unit includes a third vertical column extending from a bottom end to a top end opposite the bottom end, the bottom end of the third vertical column being welded to the top major face of the third plate. In some examples including a third structural unit, the third structural unit includes a third horizontal column having a bottom side and a top side opposite the bottom side, the bottom side of the third horizontal column being welded to the top end of the third vertical column.

Some examples including a third structural unit further comprise a fourth structural unit, the fourth structural unit being spaced from the third structural unit by the predetermined wall spacing distance, being coupled to the second structural unit with bolts. In some examples with a fourth structural unit, the fourth structural unit includes a fourth plate having a bottom major face and a top major face opposite the bottom major face, the fourth plate defining bolt holes extending from the top major face of the fourth plate through the fourth plate to the bottom major face of the fourth plate. In some examples with a fourth plate, wherein the bolt holes defined in the fourth plate align with the bolt holes defined in the top side of the horizontal column of the second structural unit. In some examples with a fourth structural unit, the fourth structural unit includes a fourth vertical column extending from a bottom end to a top end opposite the bottom end, the bottom end of the fourth vertical column being welded to the top major face of the fourth plate. In some examples with a fourth structural unit, the fourth structural unit includes a fourth horizontal column having a bottom side and a top side opposite the bottom side, the bottom side of the fourth horizontal column being welded to the top end of the fourth vertical column.

Some examples including a fourth structural unit further comprise a first set of bolts extending through the bolt holes defined in the third plate and through the bolt holes defined in the top side of the horizontal column of the first structural unit to couple the first structural unit with the third structural unit and a second set of bolts extending through the bolt holes defined in the fourth plate and through the bolt holes defined in the top side of the second horizontal column to selectively couple the second structural unit with the fourth structural unit.

In some examples including a fourth structural unit, the vertical column defines a first vertical column, the first structural unit includes a fifth vertical column horizontally spaced from the first vertical column, the fifth vertical column extending perpendicularly between the plate of the first structural unit and the horizontal column of the first structural unit, and the third structural unit includes a sixth vertical column horizontally aligned with the fifth vertical column, the sixth vertical column extending perpendicularly between the third plate and the third horizontal column.

In some examples of the first embodiment, the horizontal column longitudinally extends substantially perpendicularly to the vertical column.

In some examples wherein the horizontal column longitudinally extends substantially perpendicularly to the vertical column, the plate longitudinally extends substantially parallel to the horizontal column.

In a second embodiment of a modular support system for supporting a multi-story building, the modular support system may include a plurality of structural units selectively fastened together in a vertical arrangement, each structural unit configured to selectively couple with a vertically adjacent structural unit. In the second embodiment of the modular support system, each structural unit may include a plate having a bottom major face and a top major face opposite the bottom major face, the plate being configured to receive a fastener through the plate to secure the plate to the lower structural unit. In the second embodiment of the modular support system, each structural unit may include a vertical column extending from a bottom end to a top end opposite the bottom end, the bottom end of the vertical column being welded to the top major face of the plate. In the second embodiment of the modular support system, each structural unit may include a horizontal column having a bottom side and a top side opposite the bottom side, the bottom side of the horizontal column being welded to the top end of the vertical column, the horizontal column being configured to receive the fastener to secure the horizontal column to the upper structural unit.

A third embodiment may define a multi-story building defining a minimum load-bearing capacity selected to support structural elements of the building and expected contents of the building, including a modular support system. In the third embodiment of a modular support system for supporting a multi-story building, the modular support system may include a plurality of structural units. In modular support systems including a plurality of structural units, each structural unit may include a plate having a bottom major face and a top major face opposite the bottom major face, the plate defining bolt holes extending from the top major face through the plate to the bottom major face. In modular support systems including a plurality of structural units, each structural unit may include a vertical column extending from a bottom end to a top end opposite the bottom end, the bottom end of the vertical column being welded to the top major face of the plate. In modular support systems including a plurality of structural units, each structural unit may include a horizontal column having a bottom side and a top side opposite the bottom side, the bottom side of the horizontal column being welded to the top end of the vertical column. In modular support systems including a plurality of structural units, the horizontal column defines bolt holes extending through the top side of the horizontal column being positioned to align with the bolt holes defined in the plate. In modular support systems including a plurality of structural units, each vertical column defines a column load-bearing capacity, wherein a combined load-bearing capacity of each vertical column is at least as eat as the minimum load-bearing capacity.

In some examples of the third embodiment including vertical columns, each vertical column defines a steel column adapted for structural load beating.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A modular support system for supporting a multi-story building, comprising:

a plate having a bottom major face and a top major face opposite the bottom major face, the plate defining bolt holes extending from the top major face through the plate to the bottom major face;

a vertical column extending from a bottom end to a top end opposite the bottom end, the bottom end of the vertical column being welded to the top major face of the plate; and a horizontal column having a bottom side and a top side opposite the bottom side, the bottom side of the horizontal column being welded to the top end of the vertical column;

wherein the horizontal column defines bolt holes extending through the top side of the horizontal column being positioned to align with the bolt holes defined in the plate.

2. The support system of claim 1, wherein the plate, the vertical column, and the horizontal column collectively define a first structural unit and further comprising a second structural unit coupled to the first structural unit with bolts, the second structural unit comprising:

a second plate having a bottom major face and a top major face opposite the bottom major face, the second plate defining bolt holes extending from the top major face of the second plate through the second plate to the bottom major face of the second plate;

a second vertical column extending from a bottom end to a top end opposite the bottom end, the bottom end of the second vertical column being welded to the top major face of the second plate; and a second horizontal column having a bottom side and a top side opposite the bottom side, the bottom side of the second horizontal column being welded to the top curl of the second vertical column;

wherein the bolt holes defined in the second plate align with the bolt holes defined in the top side of the horizontal column of the first structural unit.

3. The support system of claim 2, further comprising bolts extending through the bolt holes defined in the second plate and through the bolt holes defined in the top side of the horizontal column of the first structural unit to selectively couple the first structural unit with the second structural unit.

4. The support system of claim 2, wherein:

the vertical column of the first structural unit defines a first load-bearing metallic beam; and the second vertical column defines a second load-bearing metallic column; and the vertical column of the first structural unit defines a first column gauge that is greater than a second column gauge defined by the second vertical column.

5. The support system of claim 1, wherein:

the horizontal column defines a wide-flange beam including:

a top flange defining the top side;

a bottom flange spaced from the top flange, the bottom flange defining the bottom side; and a web extending between the top flange and the bottom flange; and the bolt holes extend through the top flange.

6. The support system of claim 1, wherein:

the vertical column defines a wide-flange beam including:

a first side flange;

a second side flange spaced from the first side flange; and a web extending between the first side flange and the second side flange.

7. The support system of claim 1, wherein:

the horizontal column extends horizontally to a predetermined structural unit length; and the plate extends horizontally to the predetermined structural unit length.

8. The support system of claim 7, wherein:

the plate, the vertical column, and the horizontal column collectively define a first structural unit; and the first structural unit includes a plurality of supplemental vertical columns extending between the plate and the horizontal column, the supplemental vertical columns positioned to be equally spaced along the length of the structural unit.

9. The support system of claim 8, further comprising a second structural unit horizontally spaced from the first structural unit by a predetermined wall spacing distance and vertically parallel with the first structural unit, the second structural unit including:

a second plate having a bottom major face and a top major face opposite the bottom major face, the second plate defining bolt holes extending from the top major face of the second plate through the second plate to the bottom major face of the second plate;

a second vertical column extending from a bottom end to a top end opposite the bottom end, the bottom end of the second vertical column being welded to the top major face of the second plate; and a second horizontal column having a bottom side and a top side opposite the bottom side, the bottom side of the second horizontal column being welded to the top end of the second vertical column;

wherein the second horizontal column defines bolt holes extending through the top side of the second horizontal column being positioned to align with the bolt holes defined in the second plate.

10. The support system of claim 9, wherein the second structural unit is horizontally aligned with the first structural unit.

11. The support system of claim 9, wherein:

the second plate extends horizontally to the predetermined structural unit length; and the second horizontal column extends horizontally to the predetermined structural unit length.

12. The support system of claim 9, farther comprising a third structural unit, the third structural unit being coupled to the first structural unit with bolts and including:

a third plate having a bottom major face and a top major face opposite the bottom major face, the third plate defining bolt holes extending from the top major face of the third plate through the third plate to the bottom major face of the third plate;

a third vertical column extending from a bottom end to a top end opposite the bottom end, the bottom end of the third vertical column being welded to the top major face of the third plate; and a third horizontal column having a bottom side and a top side opposite the bottom side, the bottom side of the third horizontal column being welded to the top end of the third vertical column;

wherein the bolt holes defined in the third plate align with the bolt holes defined in the top side of the horizontal column of the first structural unit.

13. The support system of claim 12, further comprising a fourth structural unit, the fourth structural unit being spaced from the third structural unit by the predetermined wall spacing distance, being coupled to the second structural unit with bolts, and including:

a fourth plate having a bottom major face and a top major face opposite the bottom major face, the fourth plate defining bolt holes extending from the top major face of the fourth plate through the fourth plate to the bottom major face of the fourth plate;

a fourth vertical column extending from a bottom end to a top end opposite the bottom end, the bottom end of the fourth vertical column being welded to the top major face of the fourth plate; and a fourth horizontal column having a bottom side and a top side opposite the bottom side, the bottom side of the fourth horizontal column being welded to the top end of the fourth vertical column;

wherein the bolt holes defined in the fourth plate align with the bolt holes defined in the top side of the horizontal column of the second structural unit.

14. The support system of claim 13, further comprising:

a first set of bolts extending through the bolt holes defined in the third plate and through the bolt holes defined in the top side of the horizontal column of the first structural unit to couple the first structural unit with the third structural unit; and a second set of bolts extending through the bolt holes defined in the fourth plate and through the bolt holes defined in the top side of the second horizontal column to selectively couple the second structural unit with the fourth structural unit.

15. The support system of claim 13, wherein:

the vertical column defines a first vertical column;

the first structural unit includes a fifth vertical column horizontally spaced from the first vertical column, the fifth vertical column extending perpendicularly between the plate of the first structural unit and the horizontal column of the first structural unit; and the third structural unit includes a sixth vertical column horizontally aligned with the fifth vertical column, the sixth vertical column extending perpendicularly between the third plate and the third horizontal column.

16. The support system of claim 1, wherein the horizontal column longitudinally extends substantially perpendicularly to the vertical column.

17. The support system of claim 16, wherein the plate longitudinally extends substantially parallel to the horizontal column.

18. A modular support system for a multi-story building, comprising:

a plurality of structural units selectively fastened together in a vertical arrangement, each structural unit being configured to selectively couple with a vertically adjacent structural unit and including:

a plate having a bottom major face and a top major face opposite the bottom major face, the plate being configured to receive a fastener through the plate to secure the plate to the lower structural unit;

a vertical column extending from a Bottom end to a top end opposite the bottom end, the bottom end of the vertical column being welded to the top major face of the plate; and a horizontal column having a bottom side and a top side opposite the bottom side, the bottom side of the horizontal column being welded to the top end of the vertical column, the horizontal column being configured to receive the fastener to secure the horizontal column to the upper structural unit.

19. A multi-story building defining a minimum load-bearing capacity selected to support structural elements of the building and expected contents of the building, comprising:

a modular support system, the modular support system including:

a plurality of structural units, each structural unit including:

a plate having a bottom major face and a top major face opposite the bottom major face, the plate defining bolt holes extending from the top major face through the plate to the bottom major face;

a vertical column extending from a bottom end to a top end opposite the bottom end, the bottom end of the vertical column being welded to the top major face of the plate; and a horizontal column having a bottom side and a top side opposite the bottom side, the bottom side of the horizontal column being welded to the top end of the vertical column;

wherein:

the horizontal column defines bolt holes extending through the top side of the horizontal column being positioned to align with the bolt holes defined in the plate; and each vertical column defines a column load-bearing capacity, wherein a combined load-bearing capacity of each vertical column is at least as great as the minimum load-bearing capacity.

20. The multi-story building of claim 19, wherein each vertical column defines a steel column adapted for structural load bearing.

* * * * *